US009758357B2

(12) United States Patent
Anderson et al.

(10) Patent No.: US 9,758,357 B2
(45) Date of Patent: Sep. 12, 2017

(54) WINCH ASSEMBLY

(71) Applicant: Cequent Performance Products, Plymouth, MI (US)

(72) Inventors: Eric Anderson, Plover, WI (US); Kawa-She-Quoen Wm. Okerlund, Wittenberg, WI (US)

(73) Assignee: Horizon Global Americas Inc., Plymouth, MI (US)

( * ) Notice: Subject to any disclaimer, the term of this patent is extended or adjusted under 35 U.S.C. 154(b) by 591 days.

(21) Appl. No.: 14/267,197

(22) Filed: May 1, 2014

(65) Prior Publication Data

US 2014/0239243 A1 Aug. 28, 2014

Related U.S. Application Data

(63) Continuation of application No. 13/571,557, filed on Aug. 10, 2012, now Pat. No. 8,720,865, which is a (Continued)

(51) Int. Cl.
*B66D 1/30* (2006.01)
*B66D 1/14* (2006.01)

(Continued)

(52) U.S. Cl.
CPC ..... *B66D 1/14* (2013.01); *B66D 1/00* (2013.01); *B66D 1/04* (2013.01); *B66D 1/34* (2013.01);

(Continued)

(58) Field of Classification Search
CPC ... B66D 1/04; B66D 1/30; B66D 1/34; B66D 3/02

(Continued)

(56) References Cited

U.S. PATENT DOCUMENTS 747,401 A 12/1903 Foltz
822,861 A 6/1906 Mushatt (Continued)

FOREIGN PATENT DOCUMENTS

DE 1184478 B * 12/1964 ..... B66D 1/34
NZ 228633 8/1991

(Continued)

OTHER PUBLICATIONS

International Search Report and the Written Opinion, PCT/US11/62869, Cequent Performance Products, Inc., Jun. 7, 2012.

(Continued)

*Primary Examiner* — Emmanuel M Marcelo
(74) *Attorney, Agent, or Firm* — McDonald Hopkins LLC

(57) ABSTRACT

A winch assembly is described and shown herein. The winch assembly may include a first housing member having a first retaining member formed therein and a second housing member having a second retaining member formed therein, the second housing member secured to the first housing member forming a winch housing. The winch assembly may further include a drive system generally positioned within the winch housing, and a winch drum operatively coupled with the drive system and rotationally secured with the first and second retaining members.

29 Claims, 10 Drawing Sheets

Related U.S. Application Data continuation of application No. PCT/US2011/062869, filed on Dec. 1, 2011.

(60) Provisional application No. 61/418,809, filed on Dec. 1, 2010.

(51) Int. Cl.
*B66D 1/04* (2006.01)
*B66D 1/34* (2006.01)
*B66D 1/74* (2006.01)
*B66D 1/00* (2006.01)

(52) U.S. Cl.
CPC ..... *B66D 1/7452* (2013.01); *B66D 1/7489* (2013.01)

(58) Field of Classification Search
USPC ..... 242/532.5, 532.6, 532.7, 586, 586.5
See application file for complete search history.

(56) References Cited

U.S. PATENT DOCUMENTS 1,437,987 A * 12/1922 Miller ..... B66D 1/34 242/587.1
1,453,559 A 5/1923 Webb
1,547,963 A 7/1925 Seifert
1,806,606 A 5/1931 Booth
2,329,943 A * 9/1943 Robins ..... B66D 1/34 242/587.1
2,926,867 A 3/1960 Nardone
2,930,585 A 3/1960 Reeves
3,159,368 A 12/1964 Ahlbin et al.
3,497,050 A * 2/1970 Landgraf ..... B41J 33/003 242/584.1
3,520,515 A 7/1970 Pomalgalski et al.
3,582,011 A * 6/1971 Murray ..... B21C 47/323 242/125.1
3,606,193 A 9/1971 Alfred
3,900,214 A 8/1975 Brockelsby
3,910,558 A * 10/1975 Brucker ..... B60P 7/083 410/103
3,939,729 A 2/1976 Brockelsby
4,106,754 A 8/1978 Kucher
4,215,850 A 8/1980 Haase et al.
4,268,012 A 5/1981 Ruehle et al.
4,320,672 A 3/1982 Segawa
4,456,227 A 6/1984 Notenboom
4,552,340 A 11/1985 Sheppard
4,566,674 A 1/1986 Ebey et al.
4,582,298 A 4/1986 Boome et al.
4,623,104 A 11/1986 Mori
4,884,784 A 12/1989 Nix et al.
5,011,004 A 4/1991 D'Amato
5,251,877 A 10/1993 Rempinski et al.
5,320,398 A 6/1994 Popp et al.
5,346,153 A * 9/1994 Ebey ..... B66D 1/34 242/579
5,374,035 A 12/1994 Santos
5,392,109 A 2/1995 Acquaviva
5,415,377 A * 5/1995 Britt ..... B62D 43/045 242/587.1
D364,027 S 11/1995 Hung
5,573,091 A 11/1996 Hung
5,593,139 A 1/1997 Julian
5,947,450 A 9/1999 Grapes
6,021,692 A 2/2000 Norfolk et al.
6,068,210 A * 5/2000 Risa ..... B65H 75/28 242/395
6,116,580 A * 9/2000 Hull ..... B66D 1/06 254/357
6,234,509 B1 5/2001 Lara
6,332,586 B1 * 12/2001 Risa ..... A62C 33/04 242/530.2
6,431,525 B1 8/2002 Roll
6,471,191 B1 10/2002 Rotzler et al.
6,505,849 B1 1/2003 Ebey
6,883,784 B1 * 4/2005 Sloneker ..... B66D 1/14 254/366
6,971,278 B2 12/2005 Robbins et al.
7,017,887 B1 3/2006 Verakis
7,121,599 B2 10/2006 Demar et al.
7,159,852 B2 1/2007 Dow et al.
7,374,379 B2 5/2008 Booher
7,377,486 B2 5/2008 Winter et al.
7,543,800 B2 6/2009 Grapes et al.
7,556,240 B1 7/2009 Bauer et al.
7,556,241 B2 7/2009 Geagan
7,686,282 B2 3/2010 Amoss et al.
7,766,271 B1 * 8/2010 Confoey ..... B60P 7/0846 24/68 CD
7,793,919 B2 9/2010 Guyard
7,806,386 B2 10/2010 Yang et al.
7,967,278 B2 6/2011 Anderson et al.
8,231,109 B2 * 7/2012 Peng ..... B65H 75/28 242/388.5
8,720,865 B2 5/2014 Anderson et al.
2002/0104918 A1 * 8/2002 Zacharias ..... B66D 1/34 242/587.1
2005/0133772 A1 * 6/2005 Dow ..... B66D 1/04 254/341
2005/0224775 A1 * 10/2005 Ruan ..... B66D 3/14 254/372
2007/0257243 A1 11/2007 Cofer
2008/0185564 A1 8/2008 LaFreniere
2009/0114892 A1 5/2009 Lesko
2012/0298938 A1 11/2012 Anderson et al.

FOREIGN PATENT DOCUMENTS

NZ WO 2007097649 A1 * 8/2007 ..... B60P 7/083
WO WO2012/075270 6/2012

OTHER PUBLICATIONS

International Preliminary Report on Patentability, PCT/US11/62869, Cequent Performance Products, Inc., Mar. 24, 2011.
New Zealand Examination Report for Application No. 611475, Cequent Performance Products, Inc., Nov. 26, 2013.

* cited by examiner

WINCH ASSEMBLY

CROSS-REFERENCE TO RELATED APPLICATION

This application is a continuation U.S. application Ser. No. 13/571,557, entitled "Winch Assembly," filed on Aug. 10, 2012, which is a continuation of International Application No.: PCT/US2011/62869U.S., entitled "Winch Assembly" filed on Dec. 1, 2011, which claims the benefit from U.S. Provisional Patent Application No. 61/418,809 entitled "Winch Assembly" filed on Dec. 1, 2010, which is hereby incorporated in its entirety by reference.

FIELD OF INVENTION

The present invention relates generally to winch assemblies, and more particularly, to winch assemblies with a winch housing.

BACKGROUND

Towing vehicles and towed vehicles secure and haul a wide variety of cargo. Towed vehicles can be arranged to haul various types of cargo, such as boats, automobiles, all-terrain vehicles, snowmobiles, consumer products, etc. Many such cargo items are large, heavy and difficult to move or maneuver onto the bed or frame of a towed vehicle, or the load bed of the towing vehicle. To assist in moving and/or maneuvering the cargo onto the towed or towing vehicle, such towed or towing vehicles may be equipped with a winch or winch assembly.

The winch assembly is often attached to a tongue of the towed vehicle or any appropriate position on the towing vehicle. The winch assembly may also be connected to a cargo item by, for example, a strap, cable, rope, chain or the like that may aid in pulling the cargo item onto the towed or towing vehicle, as applicable. The winch assembly may typically utilize a handle to rotate a drum to wind the strap or cable around the drum thereby pulling the cargo item towards the winch. The winch assembly may also be utilized to unload heavy items from the towed or towing vehicle by rotating the drum in the opposite direction thereby unwinding the strap or chain to assist with sliding the cargo item off of the towed or towing vehicle.

The winch assembly provides a mechanical advantage to the operator making it easier to move and/or maneuver heavy cargo items. It permits an operator to otherwise move and maneuver items that he or she would not otherwise be able to move and/or maneuver. For example, this makes it possible for an operator to load a boat onto a trailer wherein he or she would not otherwise be able to so.

Many prior art winch assemblies, however, do not possess a housing or body enclosing the moving parts thereof. As such, this may cause the moving parts to be exposed to the elements, dirt, etc., which may lead to increased wear on the moving parts and also may present an aesthetically less desirable appearance. Those winch assemblies that include a housing or body encasing, however, include many moving parts that are difficult to manufacture and/or assemble. Moreover, these types of winch assemblies require many additional parts such as fasteners, brackets, etc. These additional parts may be more difficult to assemble and/or more costly to produce. Therefore, there is a need for an improved winch/winch assembly.

In addition, prior art winch assemblies are often manufactured from a formed steel stamping. This material and process may severely limit the features and aesthetics that can be incorporated into such prior art winch assemblies. Therefore, there is a need for an improved winch/winch assembly.

In the prior art, a strap bolt may be used to pass through the drum assembly (outside of the drum hub) to assemble the winch strap to the drum. The strap bolt, however, may cause a "bump" where the strap wraps around the strap bolt as the strap is wound around the drum hub and strap bolt. This bump may cause the strap to rotate eccentrically, which may create a mechanical disadvantage and may put elliptical loading on the winch assembly, which may cause it to be less effective. Therefore, there is a need for a winch assembly that may generally avoid the creation of this "bump."

In a traditional mounting application, fasteners have to be installed through the inside of the winch assembly. This may be cumbersome due to several components being located on the inside of the winch assembly. Making matters more difficult to access the mounting holes may be when a winch line is fully wound onto the drum. With this limited inside access, being able to hold down the head of the bolts is sometimes a problem when trying to tighten the nuts from the bottom side. Occasionally, parts of the winch may need to be disassembled to complete the installation. Therefore, there is a need for an improved winch/winch assembly that may have improved attaching features.

SUMMARY

A winch assembly may include a first housing member having a first retaining member formed therein and a second housing member having a second retaining member formed therein, the second housing member secured to the first housing member forming a winch housing. The winch assembly may also include a drive system generally positioned within the winch housing, and a winch drum operatively coupled with the drive system and rotationally secured with the first and second retaining members.

A winch assembly may include a first housing member, a second housing member generally vertically aligned with the first housing member and secured to the first housing member to form a winch housing. The winch assembly may also include a drive system operatively coupled with the first and second housing members, and a winch drum operatively coupled with the drive system and the first and second housing members, where the winch housing encases the drive system and winch drum on at least three sides.

A winch assembly may include a first housing member and a second housing member secured to the first housing member to form a winch housing. The winch assembly may also include a drive system generally positioned within the winch housing, a winch drum operatively coupled with the drive system and positioned within the winch housing, and where the first and second housing members directly support the winch drum.

BRIEF DESCRIPTION OF THE DRAWINGS

Operation of the invention may be better understood by reference to the detailed description taken in connection with the following illustrations, wherein.

DETAILED DESCRIPTION

Figure 1:
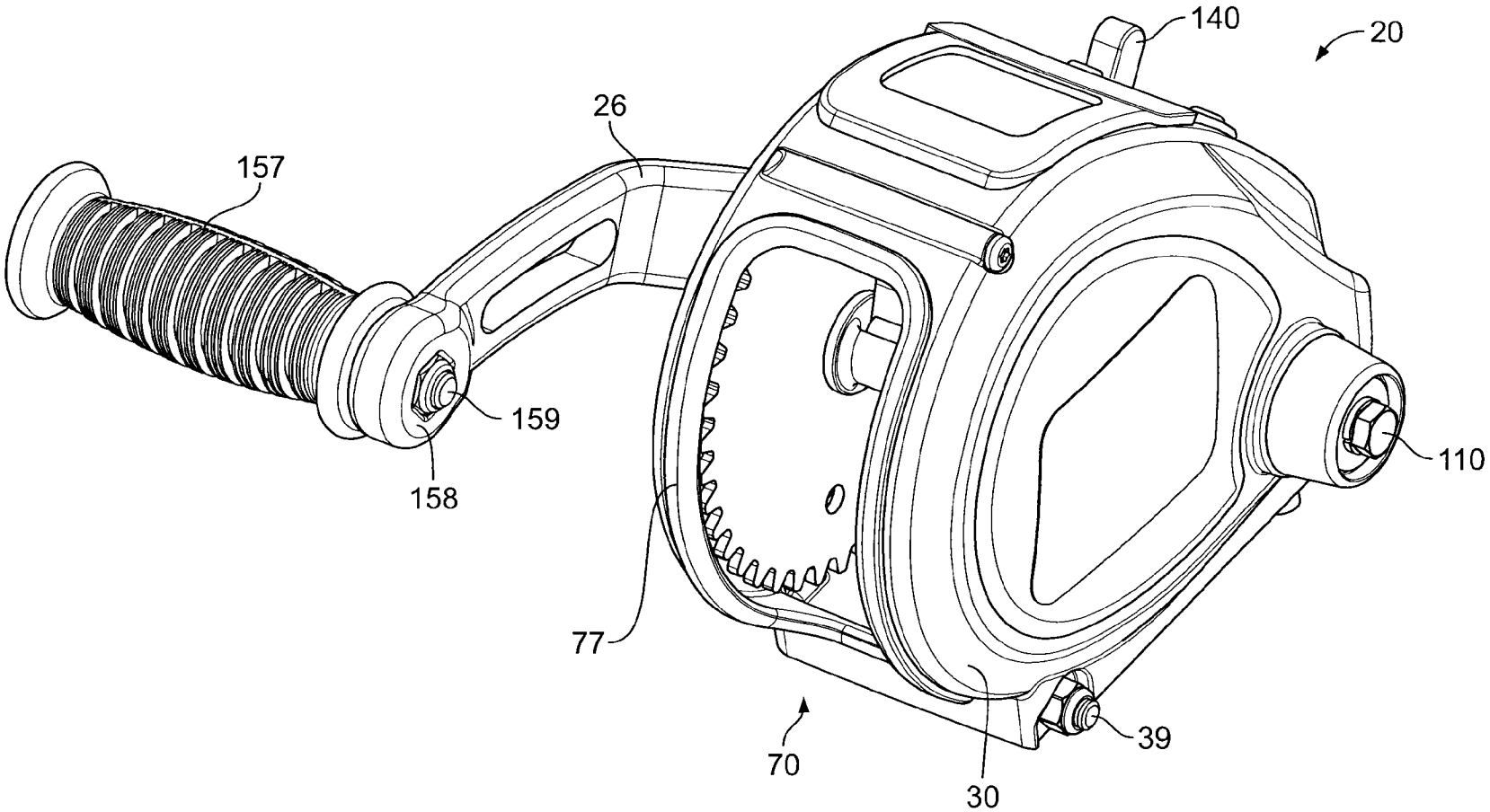
FIG. 1 is a perspective view of embodiments of a winch assembly.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A single speed dual drive winch assembly 20 is shown in FIGS. 1-6. The winch assembly 20 may provide improved aesthetics and performance to towed or towing vehicles, as applicable, including, without limitation to marine trailers. When the winch assembly 20 is properly mounted to a towed or towing vehicle the winch assembly 20 may be utilized to assist in the loading and final positioning of an item onto the towed or towing vehicle, as applicable. By way of a non-limiting example, the winch assembly 20 may be utilized to assist in the loading and final positioning of a marine vehicle onto a marine trailer. This type of situation may commonly occur while using a marine trailer to remove a marine vehicle from a body of water. The winch assembly 20, however, is not limited to use with a marine trailer. It may operate with any kind of towed or towing vehicle in which an operator needs to load and/or unload cargo and requires some mechanical assistance. In addition, the winch assembly 20 may be used without the towed or towing vehicle when an operator needs to move cargo and requires mechanical assistance.

Although a single speed dual drive winch assembly 20 is shown in the drawings, it should be understood that the present teachings are not limited to such. In other embodiments, the winch assembly 20 may include any speed winch assembly, such as by way of a non-limiting example, a dual speed dual drive winch assembly, a single speed single drive assembly or the like.

In some embodiments, the winch assembly 20 may include a handle or crank 26 and a winch housing 30 that may house the internal components of the winch assembly 20, as further described below. The winch housing 30 may include first and second housing members 34, 38, respectively. The first and second housing members 34, 38 may be fabricated from any appropriate material and fabricated in any appropriate manner, e.g., they may be die cast aluminum. By way of a non-limiting example, high pressure die casting may be utilized to fabricate the first and second housing members 34, 38. This may allow complex and aesthetic shapes to be formed, may incorporate many desirable features and components into the winch assembly 20, may provide for a high strength construction, and may make manufacturing generally easier. Further, die casting may allow for precision control of dimensions of the housing 30, may allow for forming thicker sections to strengthen the housing 30, may require fewer components and pieces to assemble, and may allow for simplified parts to assemble. While these embodiments may be produced from die-cast aluminum, it should be understood that many other materials may be used such as steel, plastic, or other rigid material and the present teachings are not limited to such.

In some embodiments, the first and second housing members 34, 38 may be attached to each other in any appropriate manner. By way of a non-limiting example, the first and second housing members 34, 38 may be attached by a fastener 39 or a plurality of fasteners 39 extending through the first and second housing members 34, 38 securing them together. In some embodiments, the first and second housing members 34, 38 may be generally vertically aligned and positioned adjacent each other and then may be secured together to form the winch housing 30.

The winch assembly 20 may further optionally include a cover piece 40 that may be attached to the first and second housing member 34, 38. The cover piece 40 may further secure the first and second housing members 34, 38 together. In some embodiments, fasteners 41 may be used to attach the cover piece 40 to the first and second housing members 34, 38 in any appropriate manner. In other embodiments, the cover piece 40 may be integrally formed with either the first and second housing members 34, 38, or with both of the first and second housing members 34, 38. Still further, in other embodiments, the first and second housing members 34, 38 may be shaped and sized such that the cover piece 40 may not be utilized in the winch assembly 20.

The winch assembly 20 may further include a winch drum 42 and a ratchet and pawl system 44. The winch drum 42 and ratchet and pawl system 44 may be generally located within housing 30. The winch drum 42 and the ratchet and pawl system 44 may be operatively coupled such that the ratchet and pawl system 44 may selectively drive and lock the winch drum 42 as further described below.

The structure of the first and second housing members 34, 38 may allow the winch drum 42 to be operatively coupled between the first and second housing members 34, 38. This may generally eliminate the requirement of a strap bolt as described above, which is often required in the prior art. The winch drum 42 may include first and second drum gears 46, 48. Although two drum gears are shown, any number of drum gears may be used, e.g., one, three, four, etc. The winch drum 42 may further include a drum hub 50. The drum hub 50 may include a center section 52, a first gear mounting portion 54, and a second gear mounting portion 56. The first drum gear 46 may mount to the first gear mounting portion 54 and the second drum gear 48 may mount to the second gear mounting portion 56. The first and second mounting portions 54, 56 may act as a self-fixture for the first and second drum gears 46, 48. In particular, the first and second mounting portions 54, 56 may each include a lip 57, 59 that may act as a stop for mounting the drum gears 46, 48 to the drum hub 50. As the gears 46, 48 are mounted onto the first and second gear mounting portions 54, 56 the gears 46, 48 may be positioned until they abut against the lips 57, 59. This may ensure that the gears 46, 48 may be properly mounted to the drum hub 50. Additionally, this may eliminate the need for any kind of strap bolt.

Figure 2:
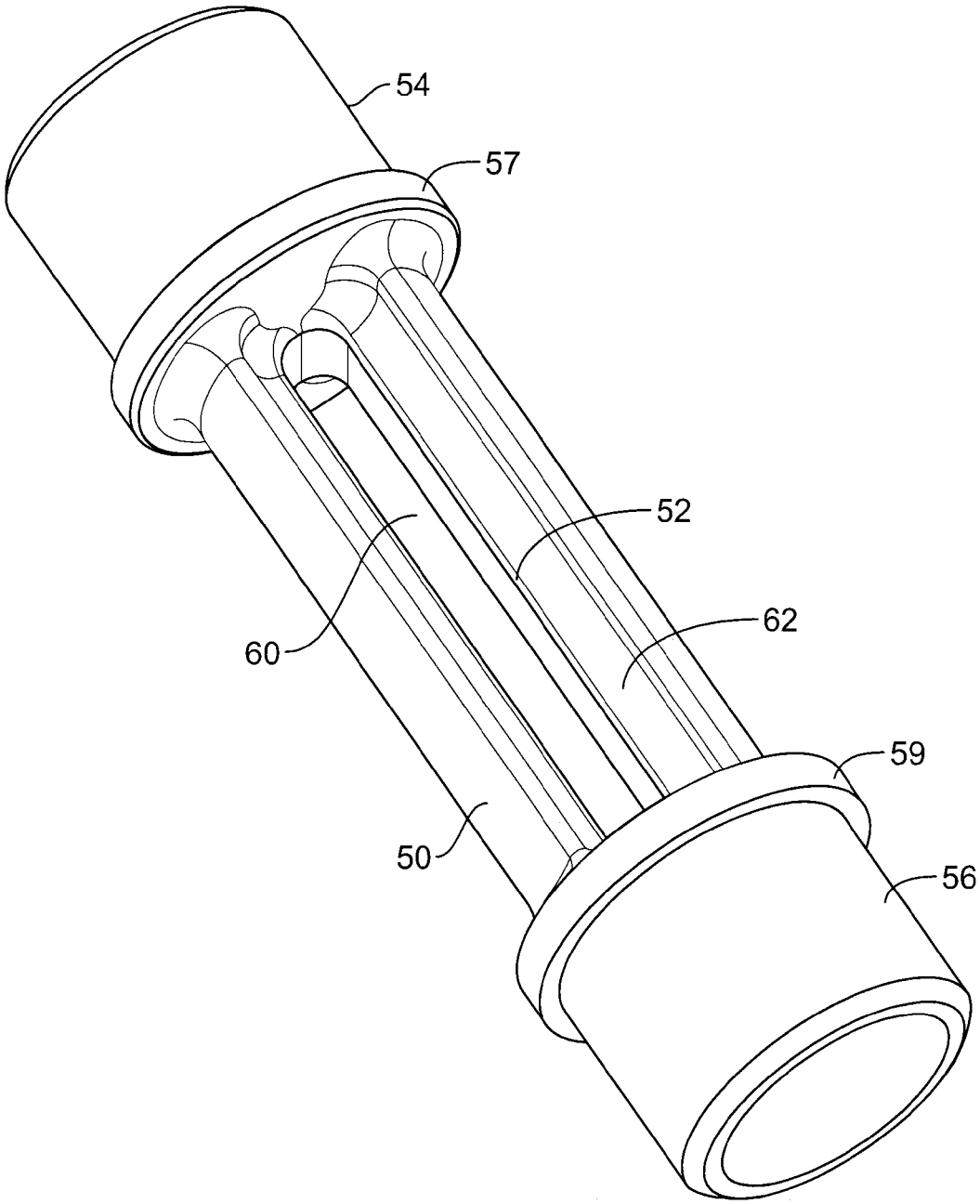
FIG. 2 is a perspective view of embodiments of a drum hub of the winch assembly.
Figure 6:
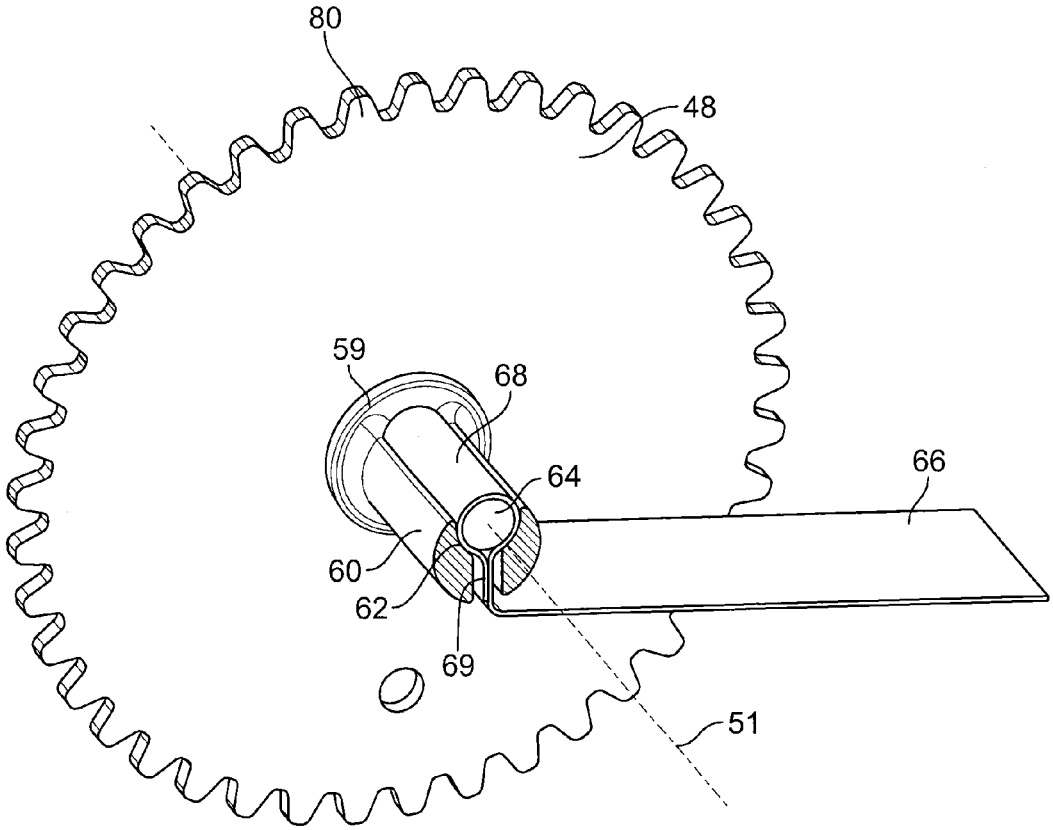
FIG. 6 is a perspective view of the drum gear and the strap engaged with the drum hub of the winch assembly in partial cross-section.
Figure 6A:
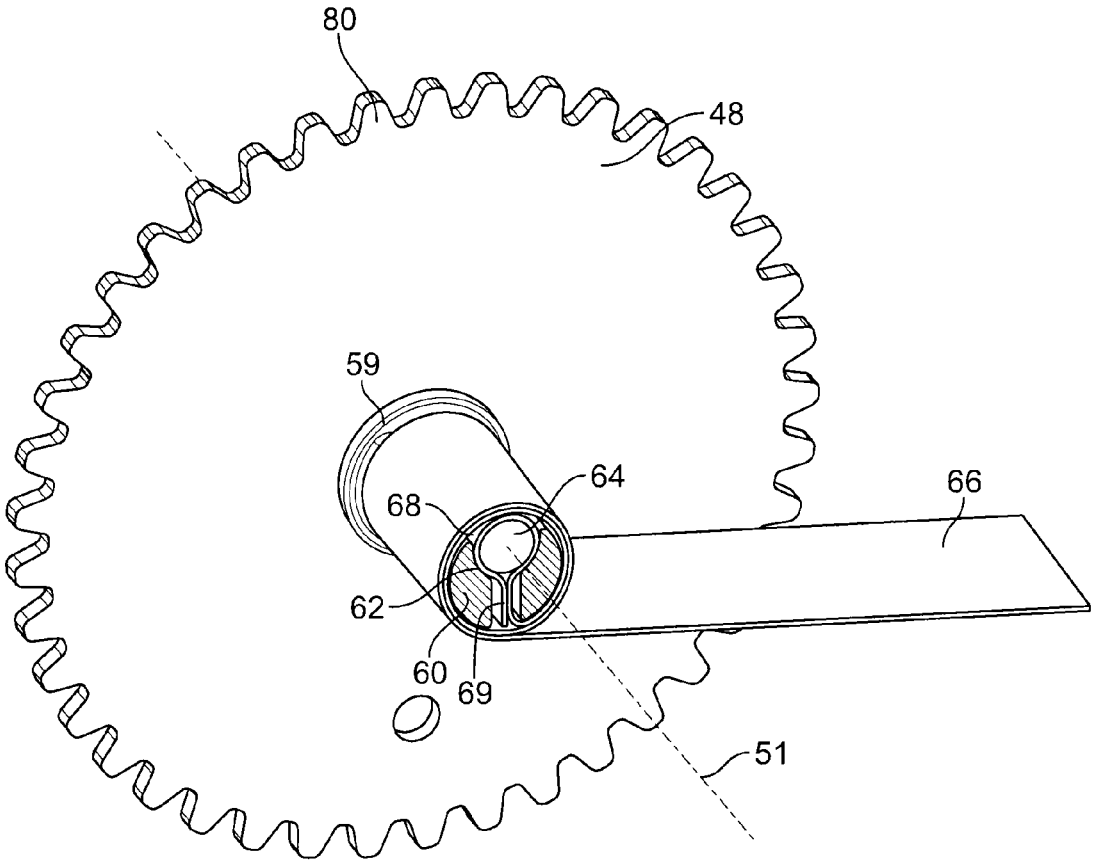
FIG. 6A is a perspective view of the drum gear and the strap engaged with the drum hub of the winch assembly in partial cross-section with a cargo connection member partially wound around the drum hub.

The center section 52 of the drum hub 50 may include a slot 60 that may generally extend through the center section 52. The center section 52 may further include a generally concave recess 62 that may be cutout from or integrally formed with the center section 52, as shown in FIG. 2. The recess 62 may be generally shaped and sized to receive a pin 64 on which a strap 66 may connect. In particular, the strap 66 may include a sewn loop 68 or any other appropriate fastening device, at an end 69 of the strap 66. The pin 64 may be shaped and sized to fit within the sewn loop 68 of the strap 66. The pin 64 and sewn loop 68 of the strap 66 may generally fit within the recess 62 such that during operation of the winch assembly 20, the strap 66 may generally concentrically wrap around the center section 52 of the drum hub 50 such that there are no "bumps." In some embodiments, pin 64—and in some embodiments the sewn loop portion 68 of the strap 66—may fit within recess 62 such that a portion of the exterior surface of pin 64—or the sewn loop 68 portion of the strap 66—may generally be an extension of the exterior surface of drum hub 50 as the exterior surfaces extend circumferentially around a central axis 51 of drum hub 50; see FIG. 6A. These configurations may generally eliminate the eccentric rotation of the strap 66 that may be otherwise caused by the drum bolt being present and protruding beyond the exterior surface of drum hub 50. These embodiments show the strap 66, however, any appropriate cargo connection member may be used, including without of limitation a cable, rope, chain or the like without departing from the present teachings.

To mount the strap 66 to the winch drum 42, the pin 64 may be inserted into the sewn loop 68 of the strap 66. The combination of the pin 68 and strap 66 may be inserted into the recess 62 such that the pin 64 may generally float freely within the recess 62. This may eliminate the need for an additional bolt to attach the strap 66 to the drum hub 50, which may also result in the drum hub 50 having a smaller diameter than prior art drum hubs. The remaining portion of the strap 66 may be pushed through the slot 60—which may acts as a strap guide—in the center section 52 of the drum hub 50 and may be fed through an integrated strap guide 70 to the outside of the winch assembly 20 for attachment to cargo (not shown). The end 69 of the strap 66 may attach to the winch drum 42 and a second end (not shown) of the strap 66 may appropriately attach to the cargo. The winch drum 42 and strap 66 may pull cargo onto the towed or towing vehicle when the winch drum 42 is rotated in a first direction and may release cargo to be removed from the towed or towing vehicle when the winch drum 42 is rotated in a second generally opposite direction.

In some embodiments, the strap 66 may be capable of attaching to the winch drum 42 without additional hardware. This may also allow the strap 66 to rotate generally concentrically, which may create a mechanical advantage and may potentially extend the life of the winch assembly 20. The absence of the strap bolt may allow the winch drum 42 to be generally "bumpless."

The first and second housing members 34, 38 may have integrally formed therewith the integrated strap guide 70. The integrated strap guide 70 may include a cut-out portion 72 in the first housing member 34 and a cut-out portion 76 in the second housing member 38, which may form an opening 77. In other embodiments, the integrated strap guide 70 may be formed in just one of the first and second housing members 34, 38 as appropriate, forming the opening 77. In those embodiments in which the first side and second housing members 34, 38 are formed together the cut-out sections 72, 76 may form the integrated strap guide 70. The integrated strap guide 70 may allow the opening 77 in the winch assembly 20 from which the strap 66 may extend may be narrower than the internal components of the winch assembly 20. This may generally protect the strap 66 from wear and grease contamination. In particular, the integrated strap guide 70 may be sized to be narrower then the winch drum 42, which may protect the strap 66 from teeth 80 on the first and second drum gears 46, 48. Generally protecting the strap 66 from the teeth 80 may prevent damage to the strap 66 and may increase the useful life of the strap 66 and the winch assembly 20.

Additionally, the strap guide 70 may provide the strap 66 with a smooth clean port of entry and exit from the winch assembly 20. This likewise may limit damage to the strap 66, which may extend the useful life of the strap 66 and the winch assembly 20. The integrated strap guide 70 may create an enclosed integrated winch housing 30 that may otherwise be devoid of mechanical clutter allowing for an aesthetically pleasing exterior design of the winch assembly 20.

Figure 3:
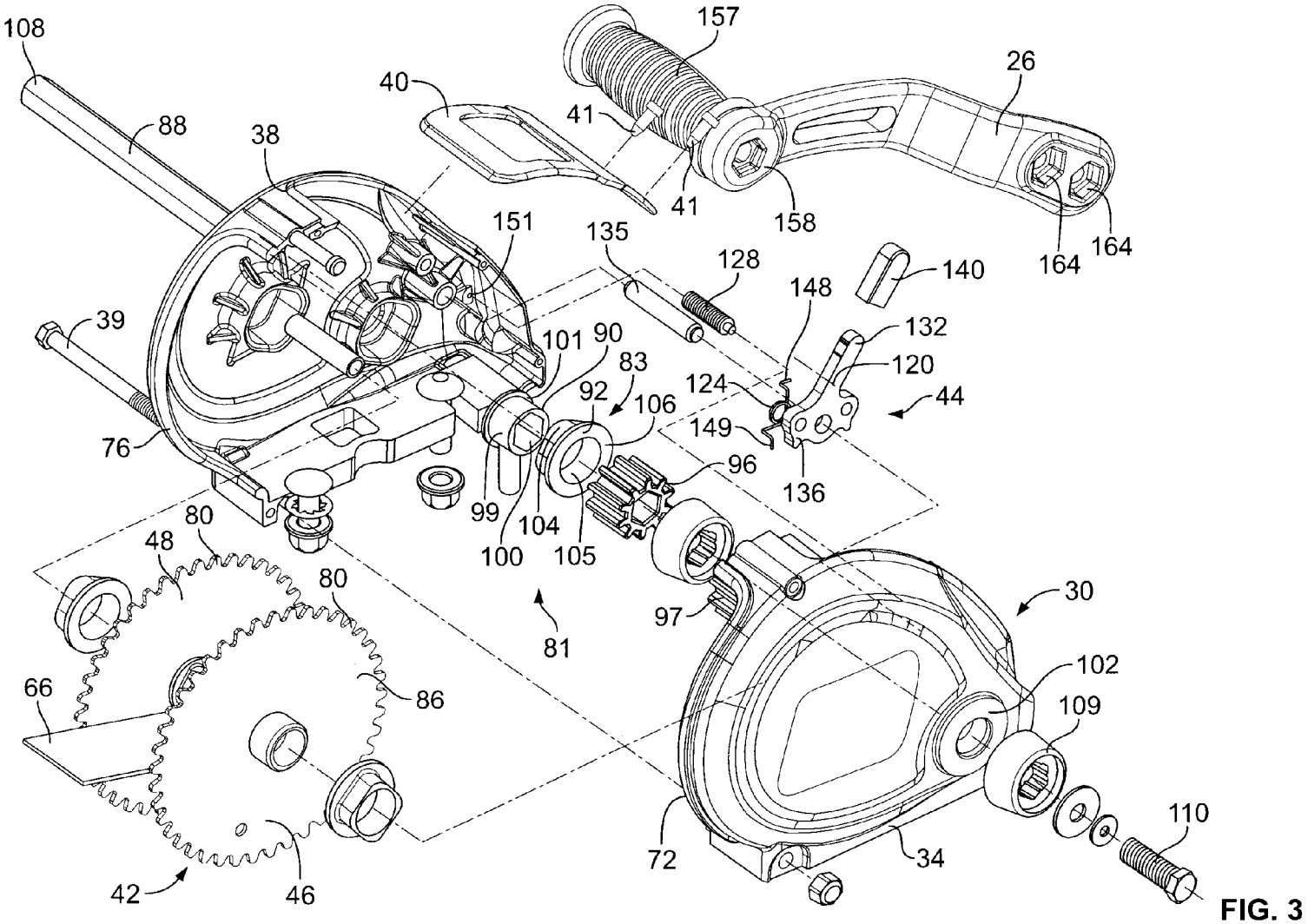
FIG. 3 is an exploded view of the winch assembly of FIG. 1.
Figure 4:
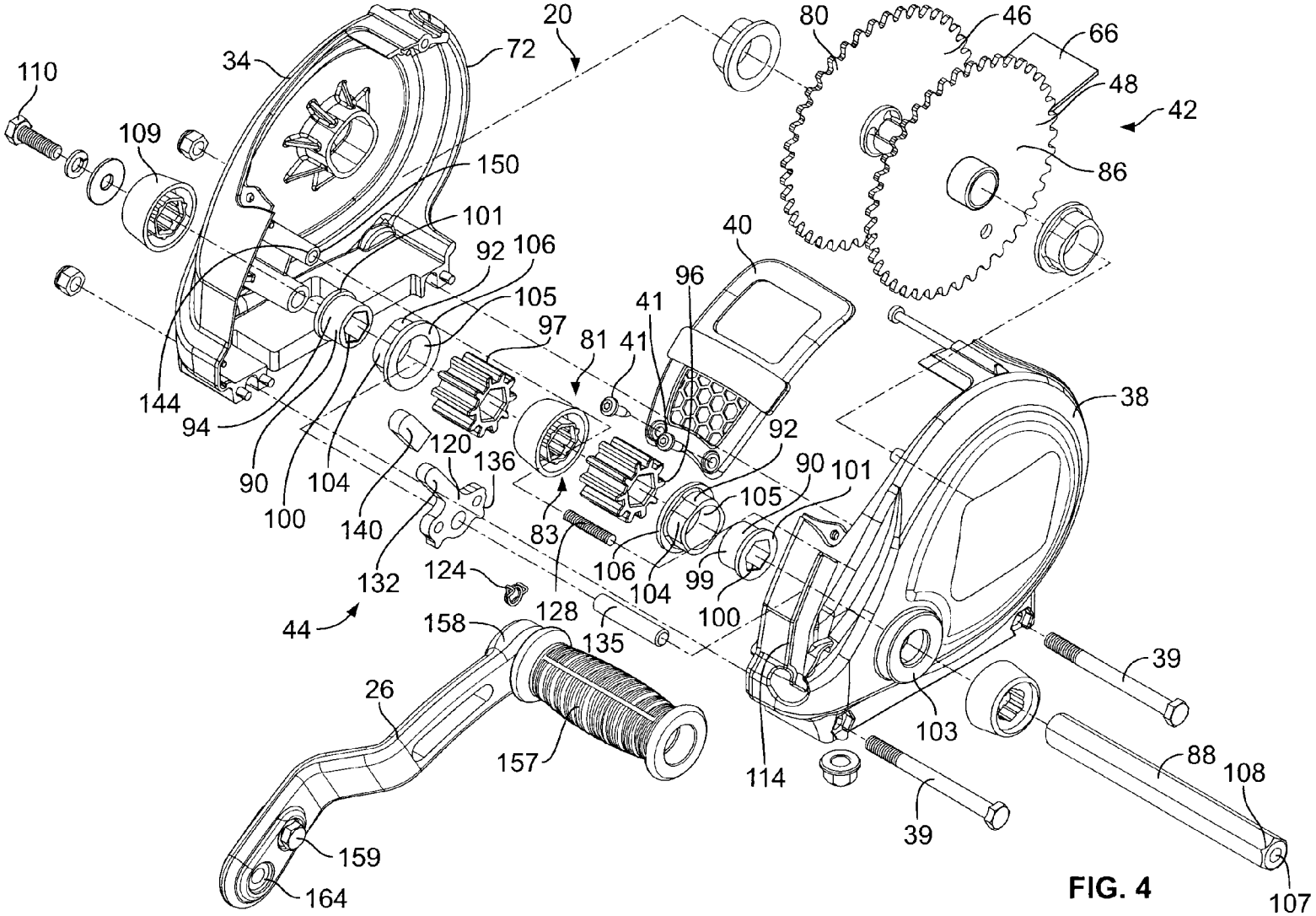
FIG. 4 is an exploded view of the winch assembly of FIG. 1.
Figure 5:
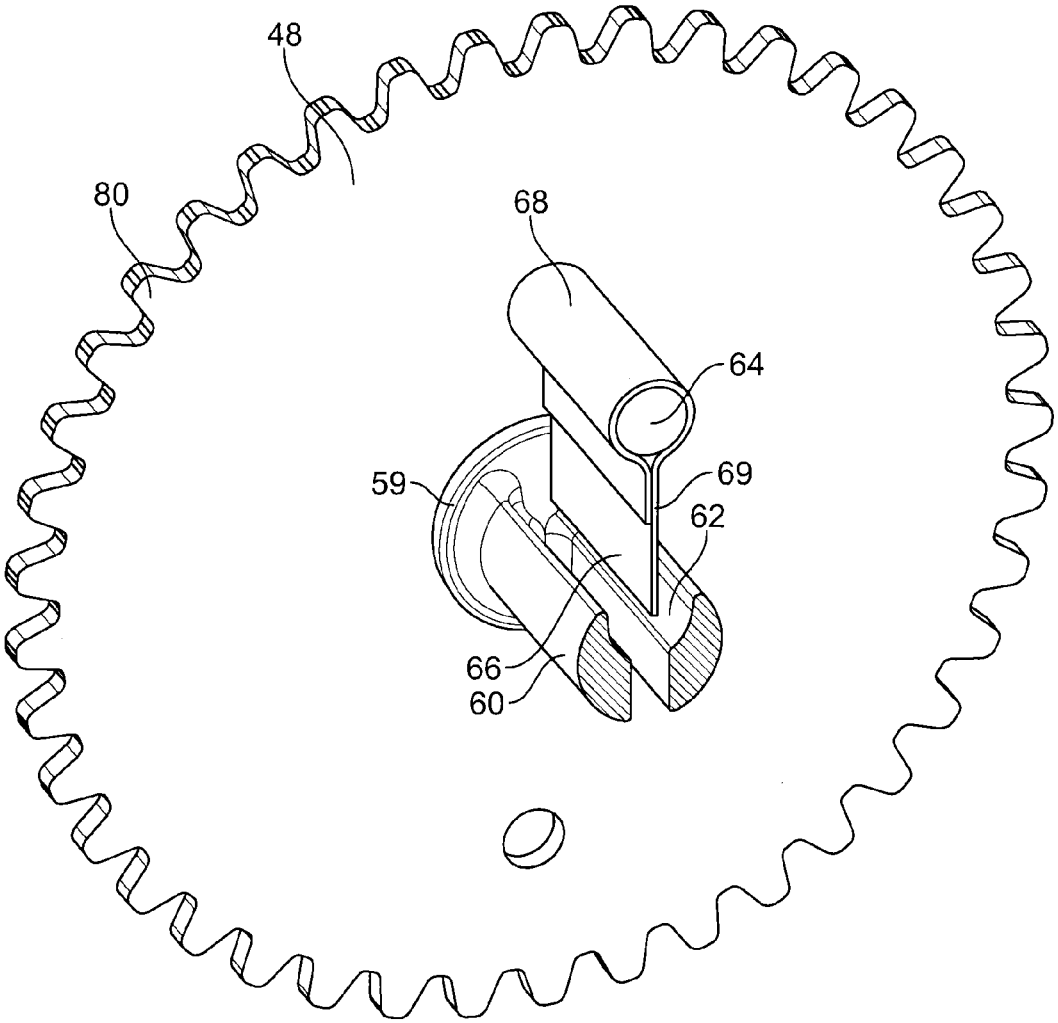
FIG. 5 is a perspective view of a drum gear and a strap disengaged from the drum hub of the winch assembly in partial cross-section.

As shown in FIGS. 3 and 4, the first and second drum gears 46, 48 may have generally straight sides 86. Prior art gears, on the other hand, typically include a sump protruding from the inner side of each gear. The sumps are typically used to encourage the strap away from the teeth of the gears. However, the construction of the winch assembly 20 may make the sump unnecessary as the first and second housing members 34, 38 may generally prevent the strap 66 from engaging the teeth 80 of the winch drum 42. Specifically, the strap guide 70 may generally prevent the strap 66 from engaging the teeth 80, which may make the sump unnecessary in the first and second drum gears 46, 48.

In some embodiments, the winch assembly 20 may include a dual drive system 81, which may be generally positioned within the winch housing 30. The dual drive system 81 of the winch assembly 20 may drive the winch drum 42 to load and unload cargo. The dual drive system 81 may include an adjustable floating winch system 83 that may be driven by the hand operated adjustable crank handle 26. The dual drive system 81 may include a drive shaft 88, a pair of first bushings 90, a pair of second bushings 92, and two drive gears 96, 97. In other embodiments, however, the winch assembly 20 may be a single drive system. The single drive system may only include a single drive gear (not shown).

In some embodiments, the first and second bushings 90, 92 may be slip bushings and may be positioned to hold the drive shaft 88 on both ends thereof. The drive shaft 88 may be of any appropriate cross-sectional shape, such as by way of a non-limiting example, a generally hexagonal cross-sectional shape. The two drive gears 96, 97 may be slip fit onto the hexagonal drive shaft 88, and each drive gear 96, 97 may operate generally independent of the other drive gear 96, 97, as applicable.

The first bushings 90 may have a generally circular outer surface 99, an appropriately shaped inner surface 100 and may include a flange 101. In some embodiments, the first bushings 90 may be slid into pockets 102, 103 within the first and second housing members 34, 38. The pockets 102, 103 may be arranged to generally match the shape of the outer surface 99 of the first bushings 90 so that the first bushings 90 may generally rotate when located in the pockets 102, 103. The first bushings 90 may be fabricated from any appropriate material, such as by way of a non-limiting example, oil impregnated self-lubricating bronze material. Such an arrangement may provide for an extended service life of the winch assembly 20.

The second bushings 92 may include a generally square outer surface 104, a generally circular inner surface 105, and may include a flange 106. The second bushings 92 may be positioned around the first bushings 90 where the circular inner surface 105 of the second bushings 92 may generally match the circular outer surface 99 of the first bushings 90. The inner surface 100 of the first bushings 90 may also be of an appropriate shape to accommodate the shape of the drive shaft 88. By way of a non-limiting example, the inner surface 100 of the first bushings 90 may be generally hexagonal in shape to accommodate the generally hexagonal shape of the drive shaft 88. In other embodiments, the drive shaft 88 may have a cross-sectional shape that may be generally circular, oval, polygonal, pentagonal, square, rectangular and the like. In these embodiments, the inner surface 100 of the first bushings 90 may generally have a similar shape as the drive shaft, i.e., generally circular, oval, polygonal, pentagonal, square, rectangular and the like as applicable. The second bushings 92 may be fabricated from any appropriate material, such as by way of a non-limiting example, a polymeric material such as nylon.

The first and second bushings 90, 92 may support the drive shaft 88 on both sides within the winch housing 30. The combination of the first and second bushings 90, 92 may functionally transform the generally hexagonal outer surface of the drive shaft 88 to a generally circular outer surface, which may facilitate smooth and efficient rotation of the drive shaft 88 within the pockets 102, 103 of the first and second housing members 34, 38. Such an arrangement may provide for a dual drive system 81 that may function smoothly even when encountering irregularities in drum gears 46, 48 due to manufacturing and assembly processes.

In some embodiments, the two drive gears 96, 97 may be positioned on the drive shaft 88 and may be arranged to drive the winch drum 42. The drive gears 96, 97 may be positioned within the first and second housing members 34, 38 and between the bushings 90, 92. The drive gears 96, 97 may engage the winch drum 42 to drive the winch drum 42 with a generally even and balanced force. These gears 96, 97 may be slip fit over the drive shaft 88 and may function or operate generally independent of each other; or in the alternative the gears 96, 97 may function generally contemporaneously.

The symmetric positioning of the drum gears 46, 48 with respect to the winch drum 42, along with the drive gears 96, 97 of the dual drive system 81 may encourage even loading and balancing of forces when the winch drum 42 is wound and unwound. Such even loading may reduce or eliminate side load conditions that may generally limit the life of the winch drum 42. Such balanced forces may increase the service life of the winch drum 42 and the drum gears 46, 48.

The drive shaft 88 may be fabricated as a one-piece steel drive shaft with apertures 107 drilled and tapped on each end 108 of the drive shaft 88. A retaining cap 109 may be engaged with an end 108 of the drive shaft 88 by use of fasteners 110.

Typical ratchet pawl systems may only be located on one side or the other of a winch assembly, thereby limiting access if the operator is on the opposite side. The present winch assembly 20, however, may permit the ratchet and pawl system 44 to be located more centrally on the winch housing 30 making it easily accessible from either side of the winch assembly 20. Moreover, most ratchet pawl systems are made of several loose components that may be cumbersome to assemble and replace if needed. The ratchet and pawl system 44 of the winch assembly 20 may be located in the middle of the winch assembly 20 and located within the winch housing 30. This may allow fewer components to be used and may generally protect the ratchet and pawl system 44 from adverse environmental exposure.

In some embodiments, the housing 30 may include an opening 114 such as the slot shown in FIG. 4. The slot 114 may be integrally formed with the winch housing 30 and may allow for the ratchet and pawl system 44 to be mounted directly to the housing 30. More specifically as shown in FIG. 4, the second housing member 38 may be integrally formed to include the slot 114. Although, it should be understood that the slot 114 is not limited to being integrally formed in the second housing member 38. In other embodiments, the slot 114 may be located in the first housing member 34 and integrally formed therewith. In other embodiments, the slot 114 may be formed through an additional operation to the first or second housing members 34, 38. The slot 114 may allow the ratchet and pawl system 44 to be mounted in an efficient manner as further described below to generally create a clean look.

The ratchet and pawl system 44 may include a ratchet pawl 120, a ratchet spring 124, and a resilient member 128. The ratchet pawl 120 may include a lever portion 132 and a gear engaging portion 136. The lever portion 132 may fit through the slot 114 formed within the housing 30. This may allow the lever portion 132 to be accessed by the operator to operate the ratchet pawl system 44. The lever portion 132 may also include a grip 140 that may be attached thereto to make it easier for the operator to grip.

As shown in FIGS. 3 and 4, the ratchet pawl 120 may attach to the first housing member 34. In other embodiments, the ratchet pawl 120 may be attached to the second housing member 38 instead of the first housing member 34. In these embodiments, the ratchet pawl 120 may attach to the housing member 34, 38—as applicable—that may not contain the slot 114. In yet other embodiments, the ratchet pawl 120 may attach to both the first and second housing member 34, 38. By way of a non-limiting example, the first housing member 34 may include a boss 144 that may be integrally formed with the first housing member 34 on which the ratchet pawl 120 may attach. This may generally eliminate the necessity for additional fasteners and parts. Although a boss 144 is shown any integrally formed fastening mechanism that may attach the ratchet pawl 120 may be utilized. In other embodiments, a pin member 135 may be utilized to secure the ratchet pawl 110 to the appropriate housing member, i.e., the first housing member 34, second housing member 38 or both the first and second housing members 134, 138.

The ratchet spring 124 may include a first end 148 and a second end 149. The first end 148 of the spring 124 may attach the ratchet pawl 120; the second end 149 may attach to the second housing member 38 or in other embodiments it may attach to the first housing member 34. As shown in FIG. 3, the second housing member 38 may include a spring connecting portion 151, which may be integrally formed with the second housing member 38. In these embodiments, the second end 149 may attach to the spring connecting portion 151 of the second housing member 38. This may eliminate the need for additional fasteners and may reduce the number of parts required for the winch assembly 20.

The first housing member 34 may include a second boss 150 that may be integrally formed therewith. The resilient member 128 may attach to the second boss 150 such that it may engage the gear engaging portion 136 of the ratchet pawl 120, which may generally eliminate additional fasteners that may be required in other prior art winch assemblies. As shown in FIGS. 3 and 4, the resilient member 128 may be a coil spring. It should be understood that the resilient member 128 is not limited to a coil spring. It may also comprise a rubber slug, a flexible plastic slug, or the like. In operation, the resilient member 128 may retain the ratchet pawl 120 in a neutral position and may be rigid enough to retain the ratchet pawl 120 in position and resilient enough to deform to allow for operation of the ratchet and pawl system 44.

The handle 26 of the winch assembly 20 may include a grip 157. The grip 157 may be of any appropriate shape or size and be located at any appropriate position on the handle 26. By way of a non-limiting example, the grip 157 may be secured to an end 158 of the handle 26 by a fastener 159. The grip 157 may help facilitate the manual rotation of the handle 26 and may make the handle 26 easier to grip. The handle 26 may be mounted on any appropriate side of the winch housing 30, such as the left or right hand side of the winch housing 30. In some embodiments, the handle 26 may be mounted on an end of the drive shaft 88 to permit manual rotation of the handle 26 in a variety of length positions. By way of a non-limiting example, the handle 26 may be fitted with a plurality of mounting locations or apertures 164 located along the handle 26. The handle 26 may thereby be positioned at a number of different positions via the adjustment apertures 164 to either shorten or lengthen the lever arm portion of the handle 26. The handle 26 may be assembled in a variety of positions depending on need and circumstances. In some embodiments, a fastener 165 may pass through the apertures 164, which may operatively secure the handle 26 to the shaft 88. Cap screws, washers, etc., as shown in the figures, may secure the handle 26 and retaining cap 106 to the winch assembly 20. All components may be assembled with a toleranced slip fit and may be universal right to left for assembly purposes. In some embodiments, the handle 26 may be selectively positioned on the right side of the housing 30, i.e., on the first housing member 34, or may be selectively positioned on the left side of the housing 20, i.e., on the second housing member 38.

The winch assembly 20 may be arranged so that it may be secured to a towed or towing vehicle or a winch stand without accessing the inside of the winch housing 30. Such an arrangement may provide for easy and quick installation of the winch assembly 20 without concern for opening or accessing the winch housing 30, unwinding the strap, etc. The winch assembly 20 may be installed using fasteners, such as nuts, bolts and washers, from the bottom of the winch assembly 20 embodiments of which are described below.

Additional embodiments of a winch assembly according the present teachings are described below. In the descriptions, all of the details and components may not be fully described or shown. Rather, the features or components are described and, in some instances, differences with the above-described embodiments may be pointed out. Moreover, it should be appreciated that these additional embodiments may include elements or components utilized in the above-described embodiments although not shown or described. Thus, the descriptions of these additional embodiments are merely exemplary and not all-inclusive nor exclusive. Moreover, it should be appreciated that the features, components, elements and functionalities of the various embodiments may be combined or altered to achieve a desired winch assembly without departing from the spirit and scope of the present teachings.

A winch assembly 200 may include an easy installation system 210. In some embodiments, the easy installation system 210 may permit the winch assembly 200 be selectively attached to an appropriate device, such as by way of a non-limiting example, a towed or towing vehicle, a winch, stand or the like. The easy installation system 210 may be located on a bottom portion 212 of the winch assembly 200.

In some embodiments, the bottom portion 212 of the easy installation system 210 may be formed from the first and second housing members 234, 238. In some embodiments, the easy installation system 210 may be attached to the bottom portion 212 of the winch assembly 200 in any appropriate manner, such as by way of a non-limiting example, by fasteners, welding, adhesives or the like. In these embodiments, the easy installation system 210 may be secured to a plate (not shown) that may be attached to the bottom portion 212 of the winch housing 300 in any appropriate manner. In other embodiments, the easy installation system 210 may be integrally formed with the winch assembly 200, or more specifically it may be integrally formed with the winch housing 230, i.e., the bottom portion 212 of the winch assembly 200. By way of a non-limiting example, the easy installation system 210 may be die cast with the winch housing 230. In other embodiments, the easy installation system may be formed with the winch housing 230 through injection mold, gravity casting, or any other appropriate process.

In some embodiments, the first and second housing members 234, 238 may each include a portion of the easy installation system 210. In these embodiments, the easy installation system 210 may be integrally formed with the first and second housing members 234, 238, such as through die casting, injection mold, gravity casting, or any other appropriate process. In other embodiments, the easy installation system 210 may be attached to the first and second housing members 234, 238, such as by way of a non-limiting example, by fasteners, welding, adhesives or the like. In still other embodiments, the easy installation system 210 may be formed in the bottom portion 212 of the winch assembly 200 or may be formed in each of the first and second housing members 234, 238 through a subsequent process, such as by machining or the like.

The easy installation system 210 may include at least one slot 242 and at least one aperture 244. Any appropriate number of slots 242 and apertures 244 may be included, however. In some embodiments, the easy installation system 210 may include a longitudinally extending slot 242*a* and a transverse slot 242*b*. At least one of the slots 242 may include the aperture 244. In some embodiments, both slots 242 may include the aperture 244. In other embodiments, only one of the slots 242*a* or 242*b* may include the aperture 244. In some embodiments, the longitudinally extending slot 242*a* may intersect the transverse slot 242*b*, or in the alternative, the longitudinally extending slot 242*a* may not intersect the transverse slot 242*b*. The slots 242, however, may take any appropriate shape and are not limited to the general T-shaped slots 242 shown.

The easy installation system 210 may include a plurality of fasteners 250 that may selectively secure the winch assembly 200 to an appropriate device. In some embodiments, the fasteners 250 may be capable of being inserted into the apertures 244—the apertures 244 may be sized to have the heads 255 of the fasteners 250 pass through and enter the apertures 244. The slots 242 may be shaped and sized to engage and generally hold the heads 255 of the fasteners 250 such that the fasteners 250 may be selectively positionable in any appropriate position along the slots 242. The slots 242 may further allow the fasteners 250 to be held in place until a nut 265 may be threaded onto the fasteners 250. In addition, the fasteners 250 may include a generally square neck 260 such that the slots 242 along with square necks 260 of the fasteners 250 may prevent these fasteners 250 from spinning while tightening. This may simplify installation and require fewer tools. In some embodiments, keeper washers 262 may be used along with the nuts 265 to appropriately secure the fasteners 250.

Figure 7:
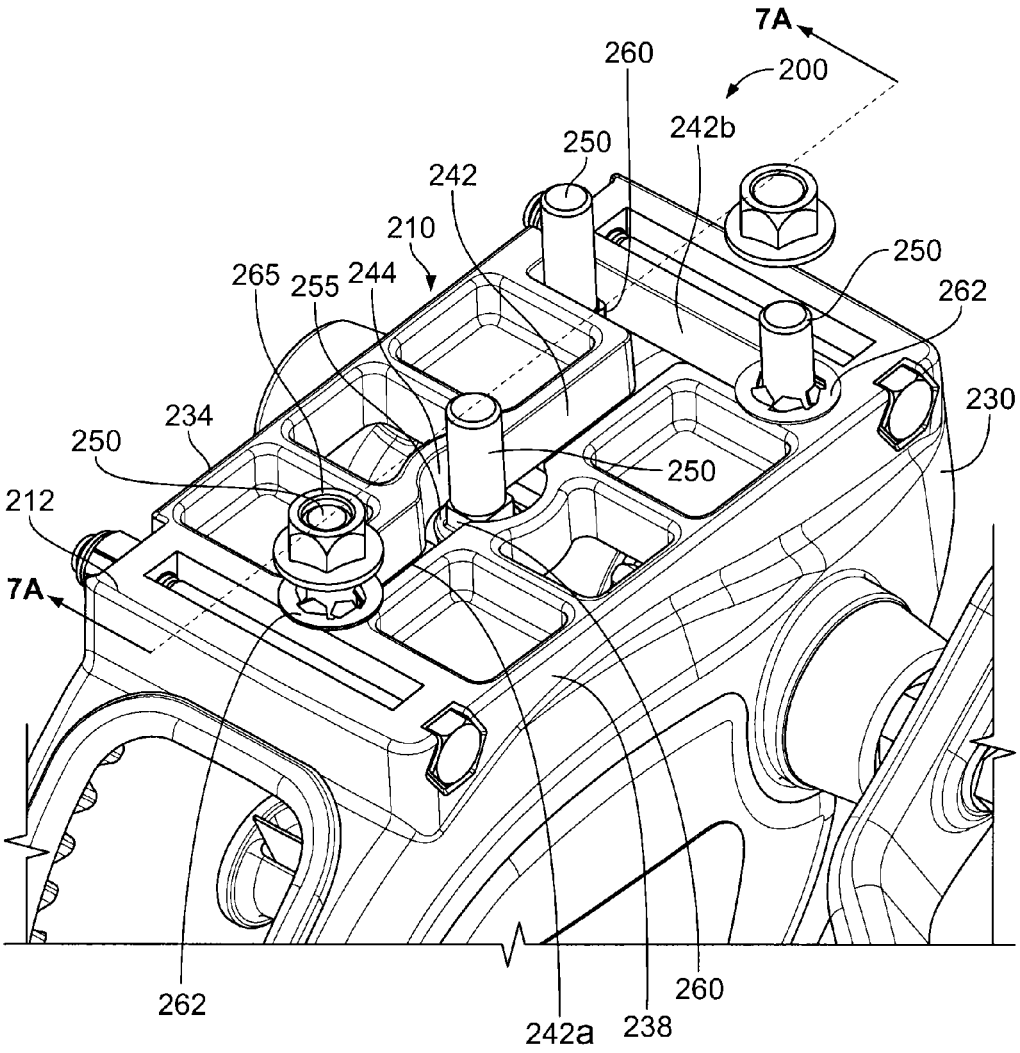
FIG. 7 is an underside perspective view of embodiments of the winch assembly.
Figure 7A:
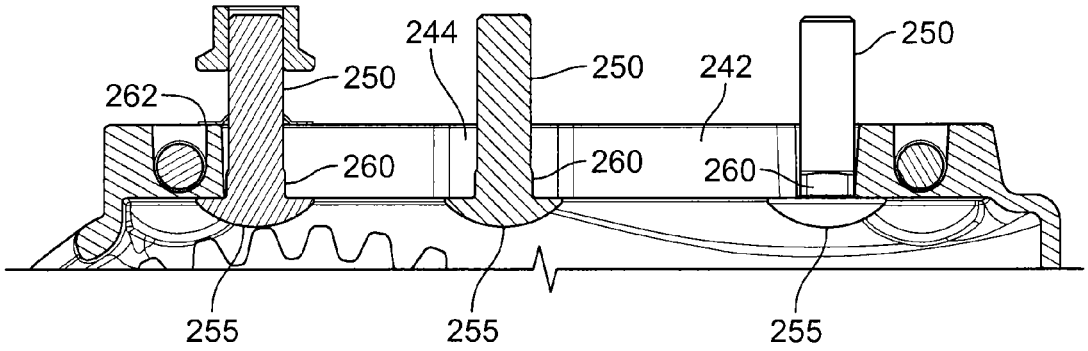
FIG. 7A is a cross-sectional view taken along line 7A-7A of FIG. 7 of a portion of the winch assembly.
Figure 8:
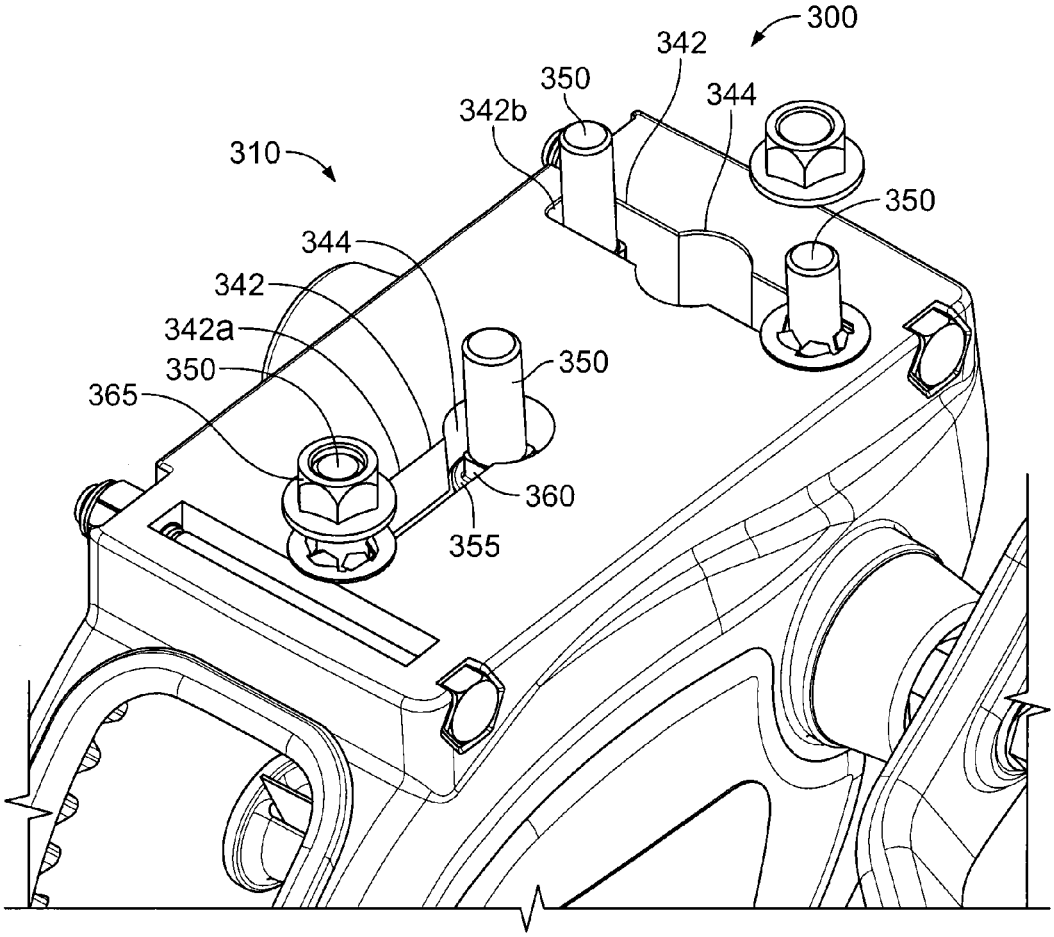
FIG. 8 is an underside perspective view of other embodiments of a winch assembly.

In some embodiments, the slots 242 may be substantially T-shaped and may allow for either two or three fasteners 250 to be used to selectively attach the winch assembly 200 to a winch or mounting stand. In these embodiments, three fasteners 250 may be used, two fasteners 250 may be located in the transverse slot 242*b* and one fastener 250 may be used with the longitudinal slot 242*b*, see FIG. 7. In these embodiments, a single aperture 244 may be used, but the present teachings are not limited to this configuration. Any appropriate configuration may be used. Alternatively, two fasteners 250 may be used to attach the winch assembly 200 to a winch or mounting stand. In these embodiments, one fastener 250 may be located in the transverse slot 242*b* and one fastener 250 may be used with the longitudinal slot 242*b*.

In operation, a consumer may insert the fasteners 250 from the bottom of the winch assembly 200, place the winch assembly 200 onto a winch or mounting stand, attach and tighten nuts 265 from the bottom side of the winch assembly 200. This arrangement may only require a single wrench to tighten the winch assembly 200 down. More specifically, the user may insert the heads 255 of the fasteners 250 through the aperture 244 and then selectively position the fastener 250 within the applicable slot 244 until it generally aligns with the appropriate position. Once the fasteners 250 are in the proper position within the slots 242, the nuts 265 may be used to tighten the fasteners 250 to securely attach the winch assembly 200 to the winch, mounting stand, or other applicable position.

In other embodiments, an easy installation system 310 of a winch assembly 300 may include a longitudinally extending slot 342*a* and a transverse slot 342*b*. In these embodiments, both slots 342 may include the aperture 344. Still further in these embodiments, the longitudinally extending slot 342*a* may not intersect the transverse slot 342*b*. The slots 342, however, may take any appropriate shape.

The easy installation system 310 may include a plurality of fasteners 350, which may selectively secure the winch assembly 300 to an appropriate device. In some embodiments, the fasteners 350 may be capable of being inserted into the apertures 344—the apertures 344 may be sized to have the heads 355 of the fasteners 350 pass through and enter the apertures 344. The slots 342 may be shaped and sized to engage and generally hold the heads 355 of the fasteners 350 such that the fasteners 350 may be selectively positionable in any appropriate position in the slots 342. The slots 342 may further allow the fasteners 350 to be held in place until a nut 365 may be threaded onto the fasteners 350. In addition, the fasteners 350 may include a generally square neck 360 such that the slots 342 along with square necks 360 of the fasteners 350 may prevent these fasteners 350 from spinning while the nut 365 is being tightened to the fastener 350.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, the following is claimed:

1. A winch assembly comprising:
a housing;
a winch drum rotatably coupled to the housing and generally held by the housing;
a drum hub attached with the winch drum;
a recess formed in the drum hub;
an engaging device; and
a cargo connection member engaged with the engaging device, wherein the cargo connection member and engaging device are positioned in the recess, whereby rotating the drum hub in a first direction wraps the cargo connection member generally concentrically wraps around the drum hub and the engaging device.

2. The winch assembly of claim 1, wherein rotation of the drum hub in a second direction opposite the first direction generally concentrically unwraps the cargo connection member from the drum hub.

3. The winch assembly of claim 1, wherein the engaging device comprises a pin.

4. The winch assembly of claim 3, wherein the drum hub includes a hub exterior surface and the pin includes a pin exterior surface, wherein at least a portion of the hub and pin exterior surfaces are generally coextensive when the pin is fitted in the recess.

5. The winch assembly of claim 3, wherein the cargo connection member comprises a strap having a loop at an end thereof, wherein the pin is engaged with the strap by inserting the pin into the loop of the strap.

6. The winch assembly of claim 5, wherein the recess is generally concave and wherein the loop and the pin inserted in the loop are capable of fitting within the generally concave recess.

7. The winch assembly of claim 6, wherein the drum hub includes a first exterior surface and the loop with the pin inserted in the loop include a second exterior surface, wherein at least a portion of the first and second exterior surfaces are generally coextensive when the loop of the strap and the pin inserted in the loop are fitted in the recess.

8. The winch assembly of claim 5, wherein the drum hub includes a slot, wherein the strap fits through the slot when the loop and the pin are inserted in the loop and fitted within the recess.

9. The winch assembly of claim 1, wherein the cargo connection member comprises at least one of a strap, cable, rope, or chain.

10. The winch assembly of claim 1, wherein the drum hub includes first and second mounting portions, whereby the first and second mounting portions are a fixture for the winch drum to attach thereto.

11. The winch assembly of claim 10, wherein the winch drum includes first and second drum gears, wherein the first drum gear is attached to the first mounting portion of the drum hub and the second drum gear is attached to the second mounting portion of the drum hub.

12. The winch assembly of claim 1, wherein the cargo connection member operatively engages the drum hub without a fastener or bolt.

13. A winch assembly comprising:

a housing;

at least one drum gear rotatably coupled to the housing and generally held within the housing;

a drum hub comprising a recess therein;

at least one gear mounting portion positioned on the drum hub, the at least one drum gear engaged with the at least one gear mounting portion;

at least one stop positioned on the drum hub, wherein the at least one drum gear engages the at least one stop to maintain the at least one drum gear in an operative position;

an engaging device; and a cargo connection member operatively engaged with the engaging device, wherein the cargo connection member and engaging device fit within the recess, whereby during rotation of the drum hub in a first direction the cargo connection member generally concentrically wraps around the drum hub and engaging device.

14. The winch assembly of claim 13, wherein at least a portion of the drum hub and an exterior surface of the portion of the cargo connection member are generally coextensive when the portion of the cargo connection member is positioned in the recess.

15. The winch assembly of claim 13, wherein the at least one drum gear includes first and second drum gears and the at least one gear mounting portion includes first and second gear mounting portions on opposed sides of the drum hub, whereby the first drum gear engaged with the first gear mounting portion and the second drum gear engages with the second gear mounting portion.

16. The winch assembly of claim 15, wherein the at least one stop includes first and second stops positioned on the first and second gear mounting portions, whereby the first drum gear engages the first stop to maintain the first drum gear in an operative position and the second drum gear engages the second stop to maintain the second drum gear in an operative position.

17. The winch assembly of claim 13, wherein rotation of the drum hub in a second direction opposite the first direction generally concentrically unwraps the cargo connection member from the drum hub.

18. The winch assembly of claim 13, wherein the engaging device comprises a pin.

19. The winch assembly of claim 18, wherein the drum hub includes a hub exterior surface and the pin includes a pin exterior surface, wherein at least a portion of the hub and pin exterior surfaces are generally coextensive when the pin is fitted in the recess.

20. The winch assembly of claim 18, wherein the cargo connection member comprises a strap having a loop at an end thereof, wherein the pin is engaged with the strap by inserting the pin into the loop of the strap.

21. The winch assembly of claim 20, wherein the recess is generally concave and wherein the loop and the pin inserted in the loop fit within the generally concave recess.

22. The winch assembly of claim 21, wherein the drum hub includes a first exterior surface and the loop with the pin inserted in the loop include a second exterior surface, wherein at least a portion of the first and second exterior surfaces are generally coextensive when the loop of the strap and the pin inserted in the loop are fitted in the recess.

23. The winch assembly of claim 22, wherein the drum hub includes a slot, wherein the strap fits through the slot when the loop and the pin inserted in the loop are fitted within the recess.

24. A winch assembly comprising:

a housing;

a drum hub positioned within the housing;

a recess formed in the drum hub; and a strap;

an engaging device engaged with the strap, wherein a portion of the strap and the engaging device fit within the recess whereby the strap generally concentrically wraps around the drum hub and engaging device during rotation of the drum hub in a first direction.

25. The winch assembly of claim 24, wherein the engaging device includes a pin inserted into the strap.

26. The winch assembly of claim 24, wherein rotation of the drum hub in a second direction opposite the first direction generally concentrically unwraps the strap from the drum hub.

27. The winch assembly of claim 24, wherein the strap includes a loop at an end thereof, whereby the engaging device is inserted into the loop.

28. The winch assembly of claim 27, wherein the recess is generally concave whereby the loop and the engaging device inserted in the loop fit within the generally concave recess.

29. The winch assembly of claim 28, wherein the drum hub includes a first exterior surface and the loop with the engaging device inserted in the loop include a second exterior surface, whereby at least a portion of the first and second exterior surfaces are generally coextensive when the loop of the strap and the engaging device inserted in the loop are fit in the recess.

* * * * *